United States Patent [19]

Bardin et al.

[11] Patent Number: 4,738,320

[45] **Date of Patent: * Apr. 19, 1988**

[54] METHOD AND IMPROVEMENT TO DRILLING TOOLS ALLOWING GREAT EFFICIENCY IN CLEANING THE CUTTING FACE

[75] Inventors: Christian Bardin, 25, rue Charles Duport, 92270 Bois Colombes; Henri Cholet, 10, allée des Lilas, 78230 Le Pecq, both of France

[73] Assignees: Christian Bardin; Henri Cholet, both of France

[ * ] Notice: The portion of the term of this patent subsequent to Mar. 29, 2005 has been disclaimed.

[21] Appl. No.: 749,286

[22] Filed: Jun. 27, 1985

[30] Foreign Application Priority Data

Jun. 27, 1984 [FR] France ..... 84 10123

[51] Int. Cl.[4] ..... E21B 10/18

[52] U.S. Cl. ..... 175/65; 175/393

[58] Field of Search ..... 175/65, 339, 340, 393, 175/422

[56] References Cited

U.S. PATENT DOCUMENTS

| | | | |
|---|---|---|---|
| 2,776,115 | 1/1957 | Williams, Jr. | 175/339 |
| 2,807,444 | 9/1957 | Reitschneider | 175/339 |
| 3,144,087 | 8/1964 | Williams, Jr. | 175/339 |
| 3,220,754 | 11/1965 | Mori | 175/393 |
| 3,746,108 | 7/1973 | Hall | 175/393 |
| 4,296,824 | 10/1981 | Kennington | 175/340 |
| 4,540,056 | 9/1985 | O'Hanlon | 175/393 |
| 4,546,837 | 10/1985 | Childers et al. | 175/340 |

*Primary Examiner*—Stephen J. Novosad
*Assistant Examiner*—William P. Neuder
*Attorney, Agent, or Firm*—Antonelli, Terry & Wands

[57] ABSTRACT

A method and improvement to drilling tools efficient cleaning of the cutting face. The method improves the removal of cuttings from a drilling tool rotating, more especially on itself in operation, about the axis of the tool, said tool comprising a body having a first end adapted for connection to rotary drive means and the second end defining a cutting face. The zone of said second end adajcent said axis is designated as the central part of the tool and said tool comprises at least one nozzle. The method consists in positioning said nozzles so as to produce a flow orientated towards the central part of the tool, the vector obtained by the orthogonal projection on a plane perpendicular to the axis of the tool of the speed of said flow in the central part of the tool being zero at any point of said central part, said vector forming the effective speed vector.

9 Claims, 4 Drawing Sheets

PL_III_4

METHOD AND IMPROVEMENT TO DRILLING TOOLS ALLOWING GREAT EFFICIENCY IN CLEANING THE CUTTING FACE

BACKGROUND OF THE INVENTION

1. Field of the Invention

The present invention relates to an improved rotary drilling tool having great efficiency in cleaning the cutting face.

2. Description of the Prior Art

Rotary drilling tools are already known comprising a body having a first end connected to rotary drive means and a second end defining the cutting face. Such tools are described in the U.S. Pat. Nos. 3,645,346; 4,323,130; and 3,838,742 and the British patent GB-A-2 047 308.

It is also known to improve cleaning of the cutting face and removal of the spoil or cuttings by positioning nozzles whose jets are slanted with respect to the cutting face and therefore strike the wall at an incident angle different from 90°.

A drawback of the prior art resides in the fact that the distribution at present adopted for these jets does not promote good cleaning of the central part of the tool, which limits the feeding speed performances of the tool and increases the wear thereof.

The object of the invention is to propose an improvement to drilling tools so as to increase the performances thereof by more efficient removal of the spoil or cuttings from the cutting face and more particularly in the central part, or central zone, of the tool.

The present invention may be applied to drilling tools or drilling bits working by removing chips (blade tools) or by abrasion. The first tools mentioned generally comprise cutting elements made from polycrystalline synthetic diamond, the second generally comprises natural diamonds.

SUMMARY OF THE INVENTION

This objective is obtained in accordance with the present invention by orientating at least one jet slanted preferably towards the central part of the tool, the other jets not interfering with this first jet.

In the present text speed generally refers to the mean speed obtained from integration of the speeds over the shortest distance separating the tool from the geological formation.

The jet or jets orientated preferably towards the central part of the tool must be positioned so that the vector of the flow speed obtained by the orthogonal projection on a plane perpendicular to the axis of the tool in the central part of the tool is different from zero. This vector will be called effective speed vector. With this jet or a plurality of such jets orientated preferably towards the central part of the tool will be advantageously associated one or more jets whose flow is preferably directed away from the central part of the tool this jet or plurality of jets not being located on the straight line segment passing through the axis of the tool and the starting point of such a jet being orientated preferably towards the central part of the tool; this straight line segment is limited by the axis of the tool and by the starting point of the jet orientated preferably towards the central part of the tool.

Thus, the invention relates to a method for improving the removal of cuttings from a drilling tool rotating, in operation, about an axis of the tool. This tool comprises a body having a first end adapted for connection to a rotary drive means and a second end defining the cutting face, the zone of the second end adjacent said axis being called or designated as the central part of the tool, the tool being equipped with at least one nozzle with a jet for directing a fluid across the cutting face.

More exactly, the central part or central zone of the tool is defined by the part of the tool adjacent the center of the tool. This center is itself defined as being the intersection of the axis of the tool with the outer surface of the tool.

The method of the invention is characterized in that the nozzle is positioned to produce a flow orientated towards a central part of the tool, the vector of the speed of said flow obtained by the orthogonal projection on a plane perpendicular to the axis of the tool in the central part of the tool being different from zero at any point of the central part of the tool. This vector will be designated as the effective speed vector as has already been mentioned above.

The method of the invention may be applied to the case of a tool comprising several nozzles. In this case, these nozzles are positioned and dimensioned so as to produce a resultant flow in the center of the tool whose effective speed vector is different from zero at any point of the central part of the tool.

Still within the scope of the present invention, the tool may comprise additional nozzles adapted for producing flows having a tangential speed component different than zero, with respect to a circle centered on a point belonging to the axis of the tool.

In a different embodiment of the method of the invention, the nozzle or nozzles are positioned so that there exists at least one axis, called the circulation axis, belonging to the plane perpendicular to the axis of the tool. The orthogonal projections on this axis of the different effective speed vectors of the central part of the tool are called circulation vectors. In this embodiment, all the circulation vectors are orientated in the same direction.

Of course, said axis may be a curved line. But preferably, it will be a straight axis passing through the axis of the tool.

The present invention also relates to a drilling tool for implementing the method and these variants described above.

This tool is characterized in that it comprises at least a first nozzle positioned at a first position of the tool, said nozzle comprising an injection channel whose axis is orientated substantially towards the central zone of the tool.

In a different embodiment, the tool of the invention may comprise at least a second nozzle positioned on the side of the tool opposite that containing the first nozzle, said opposite side being defined by the portion of the tool situated in the half space defined by a first plane passing through the axis of the tool, perpendicular to a second plane containing a point of the injection orifice of said first nozzle as well as the axis of the tool and not containing said first nozzle, said second nozzle comprising an injection channel adapted for producing a flow substantially orientated in the direction opposite that defined by the central zone of the tool.

In another embodiment, the second nozzle may be positioned on the tool substantially in a half plane belonging to the second plane, this half plane being defined by the axis of the tool and does not contain the first nozzle.

In another embodiment, the tool may comprise several nozzles having fluid injection channels having an axis orientated towards the central zone of the tool. These nozzles being positioned on the tool on the same side with respect to a plane passing through the axis of the tool.

In another embodiment, the tool may comprise a third nozzle having a third channel, said third nozzle being positioned substantially in the vicinity of said first nozzle, the axis of said first channel being orientated substantially in the direction opposite that of the first nozzle.

BRIEF DESCRIPTION OF THE DRAWINGS

The present invention will be better understood and its advantages will be clear from the following description of various embodiments illustrated in the accompanying Figures in which.

DESCRIPTION OF THE PREFERRED EMBODIMENT

Figure 1:
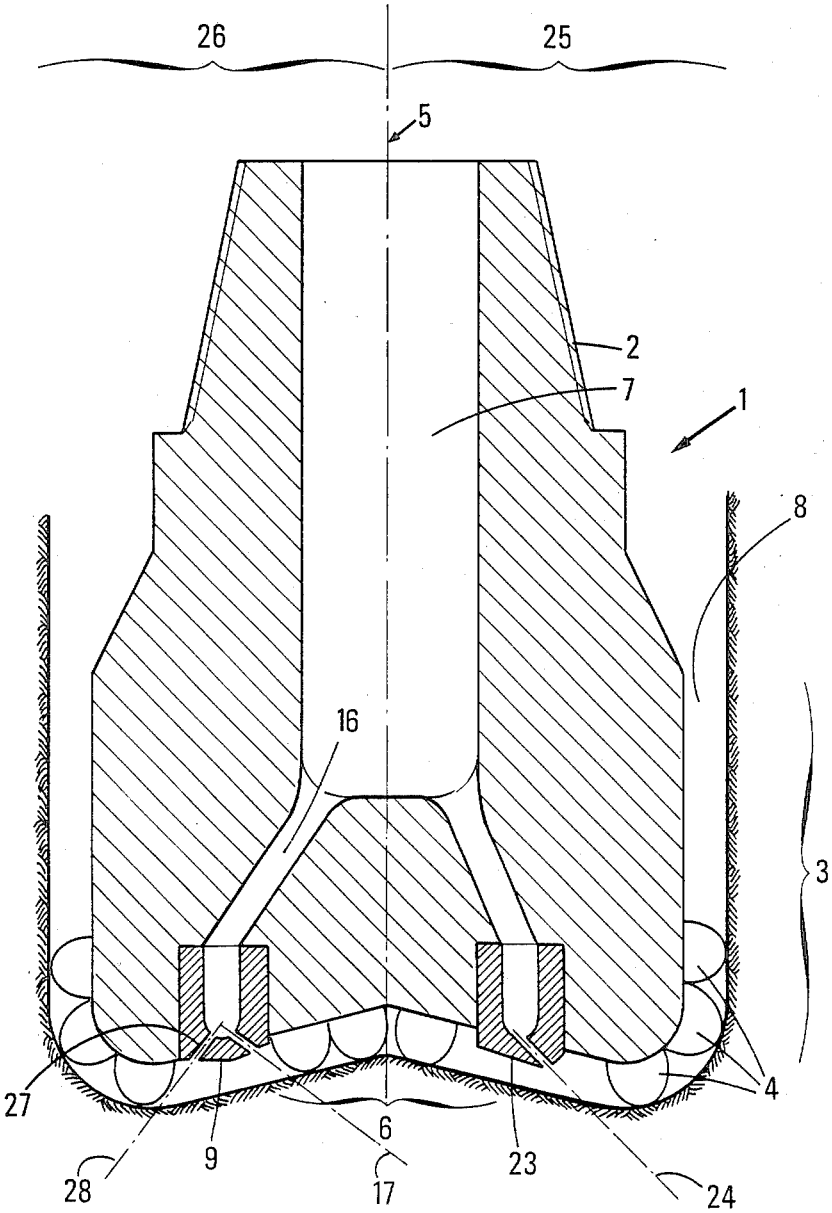
FIG. 1 shows a drilling tool comprising improvements according to the present invention.

In FIG. 1, reference 1 designates generally the body of the drilling tool or drilling bit according to the invention which will, for example, be made from special steel. At a first one of its ends, this tool is adapted for connection to a rotary drive means, for example by means of a threaded portion 2. The means for rotating the tool will comprise a tool holder to which the drilling bit is secured, and which forms a part of the rotary drilling stringer, or which may be directly rotated by the rotor of a bottom motor.

The second end or head 3 of the drilling bit comprises a face defining the cutting face of the tool, this face comprising a plurality of means 4 for destroying the formation to be drilled.

Reference 5 designates the axis of the tool and reference 6 designates the central part or the central zone of the tool which may be defined by way of example by the part of the surface of the second end of the tool included inside a cylinder whose axis coincides with the axis of tool 5 and whose diameter is equal to the outer diameter of a tool divided by three.

Clearing of the cuttings and removal thereof is achieved by circulating the drilling fluid which is brought by the string of rods into the inner cavity 7 of the drilling bit. The fluid is then distributed through a bore 16 to at least a first nozzle 9 having a fluid injection channel whose axis 17 is orientated substantially towards the central zone 6 of the tool.

Figure 2:
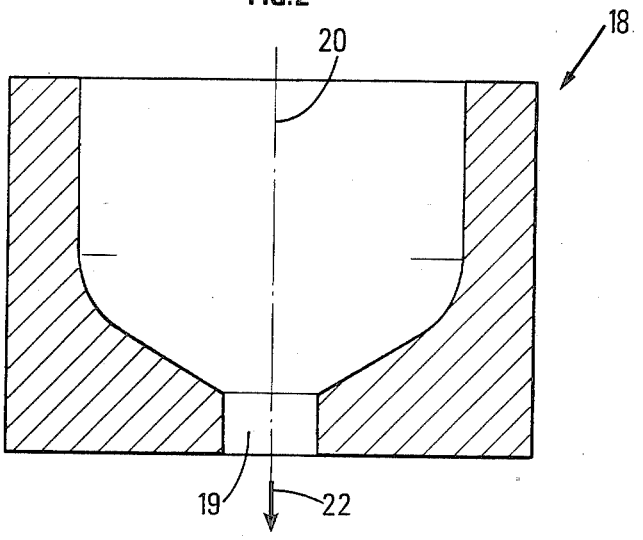
FIG. 2 shows a nozzle.

In the present description, the term "injection channel of the nozzle" means the part of the nozzle which will orientate the direction of the fluid jet, thus in FIG. 2 the channel of nozzle 18 corresponds to passage 19. The axis 20 of channel 19 of nozzle 18 may be defined as the resultant direction of the flow, or of the jet, produced by this channel 19.

In the present description, the axis 20 of channel 19 of nozzle 18 is assumed to be orientated in the direction of the flow produced by the nozzle, this direction is shown in FIG. 2 by arrow 22.

It is obvious that still within the scope of the present invention, nozzles may be used having passage sections of different forms, which remains important considering the direction and more exactly the orientation of the axis of these nozzles such as defined above.

The fluid coming from nozzle 9 is removed through the annular zone 8 (FIG. 1).

The drilling bit 1 of FIG. 1 comprises a second nozzle 23 which has an axis 24 orientated towards the annular zone 8.

This second nozzle is situated on the side of the drilling bit 25 opposite that containing the first nozzle and which bears the reference 26.

Said opposite side 25 is defined by the portion of the tool which is situated in the half space defined by a first plane passing through the axis of the tool perpendicular to a second plane containing a point of the injection orifice of the first nozzle 9 as well as the axis of the drilling bit and which does not contain the first nozzle 9. In the case of FIG. 1, the second plane corresponds to the plane of the Figure itself.

The drilling bit of FIG. 1 comprises a third nozzle 27 which may be supplied through the same bore 16 as that which supplies the first nozzle 9.

The axis 28 of the channel of this third nozzle 27 is orientated substantially in the direction opposite that of the first nozzle. It should be understood by that that the nozzle 27 has a fluid injection channel which creates a flow moving away from the plane perpendicular to the axis 17 of the first channel.

Of course, the third nozzle 27 may be supplied through an independent bore different from the one supplying the first nozzle 9.

Still within the scope of the invention, at least one of the above mentioned nozzles produces a jet which, on leaving said nozzle, is parallel to the cutting face and/or to the surface of the tool. This is tantamount to saying that the axis of said nozzle is parallel to the cutting face and/or to the cutting surface of the tool.

Figure 3:
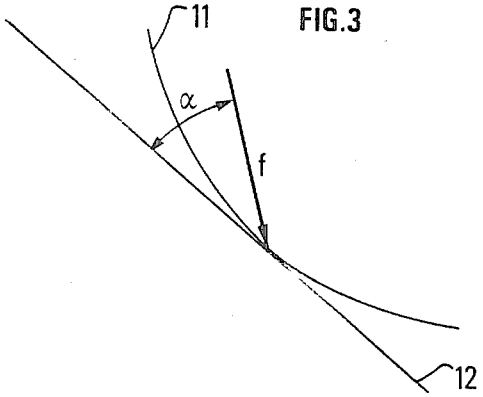
FIGS. 3 and 4 show diagrams for defining different angles.

In FIG. 3, reference 11 shows the cutting face such as it is cut by the tool. Reference 12 shows the plane tangent to the cutting face at the point of impact of the jet thereon.

Figure 4:
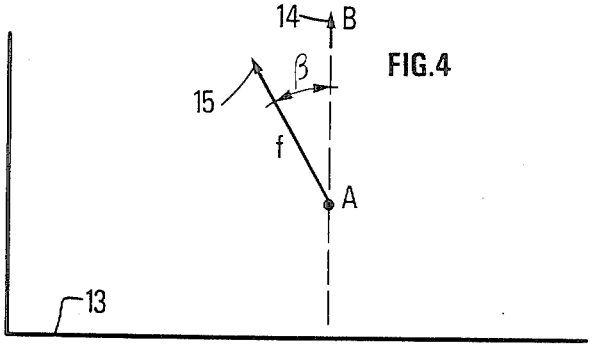

In FIG. 4, reference 13 shows the plane tangent to the cutting face at the point the nearest to the nozzle from which jet f is supplied. Reference 14 is the projection orientated in the direction of advance of the tool of the axis of tool 5 on plane 13. Reference 15 designates the projection of the path of jet f at the outlet of the nozzle in projection on plane 13. $\beta$ is the angle formed by projections 14 and 15. Angle $\beta$ is calculated from the half straight line AB where A is the point of intersection of projections 14 and 15.

The jets used are jets slanted with respect to the cutting face, so that the angle $\alpha$ which jet f forms with the plane 12 tangent to the cutting face at the point of impact of this jet is different from 90°.

It is obvious that the direction of the jet merges substantially with the axis of the nozzle which produces it.

A jet orientated preferably towards the central part of the tool is any jet coming from a nozzle outside this central part 6 and the orthogonal projection of the path of which on a plane perpendicular to the axis 5 of the tool is partially in the orthogonal projection on this plane of the central part 6 of the tool.

Also considered as jet orientated preferably towards the central part of the tool is any jet coming from a nozzle inside this central part 6 and orientated preferably towards the center of the tool. A jet is called jet orientated preferably towards the central part of the tool when the angle $\beta$ defined in FIG. 4 has a value less than 90°.

Figure 5:
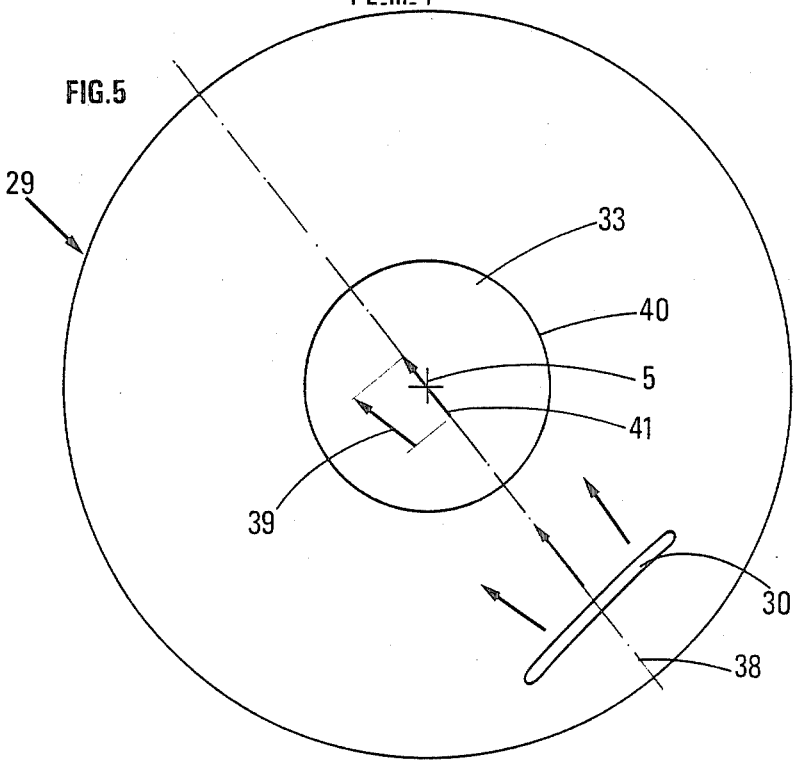
FIG. 5 shows a tool comprising an elongate nozzle.

Still within the scope of the present invention, the drilling bit 29 may comprise a single nozzle 30 of oblong shape (FIG. 5).

The plane of this Figure corresponds to a plane perpendicular to the axis of tool 20. Axis 38 represents the axis of circulation of the fluid.

Arrow 39 represents an effective speed vector obtained by the orthogonal projection on the plane of the Figure of a speed vector of the flow in the central part of tool 33.

Circle 40 shows the orthogonal projection on the plane of the Figure of the limit of the central zone 33.

Reference 41 designates the circulation vector obtained by the orthogonal projection of the effective speed vector 39 on the circulation axis 38.

The circulation vector 41 may be obtained directly by the projection, in a plane perpendicular to the circulation axis 38, of the flow speed on the circulation axis 38.

The different circulation vectors of the central part of the tool are orientated in the same direction.

Application of the invention leads to improved efficiency when all the jets are slanted with respect to the cutting face, but it keeps its value when one or more jets are not slanted with respect to the cutting face.

The value of angle $\alpha$ for a slanted jet will be advantageously less than 45°.

The value of angle $\beta$ for a jet orientated preferably towards the central part of the tool will be advantageously less than 45°.

The jets orientated preferably towards the central part of the tool will be preferably situated on the same side of the plane passing through the axis 5 of the tool so as to prevent these jets from being annihilated in the central part of the tool.

Figure 6:
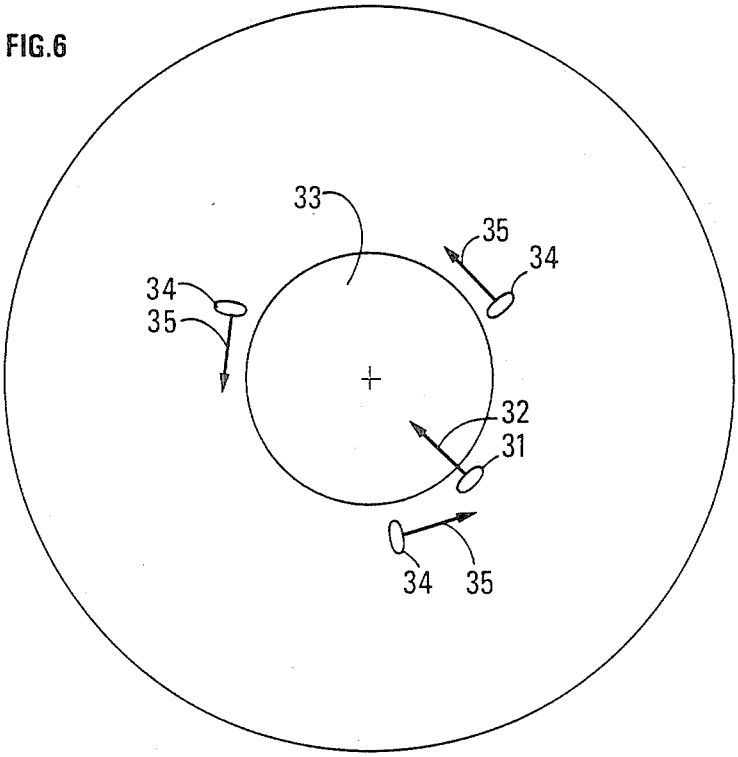
FIG. 6 shows a drilling tool, comprising several nozzles.

FIG. 6 shows a possible application of the present invention allowing good cleaning of the tool and of the cutting face. This tool comprises a nozzle 31 creating a jet 32 orientated towards the central part 33 of the tool and whose essential function is to correctly clean said central part 33.

Nozzles 34 create jets 35 which are not orientated towards the central part of the tool 33 and whose essential function is to clean the surface of the tool in contact with the cutting face, this surface comprising that which is different from the central part of the tool. In the case of FIG. 6, nozzles 34 create a centrifugal rotary flow particularly efficient in cleaning the tool and in particular the periphery of the tool.

The nozzles positioned on the tool may be removable or fixed, of identical section or not. The fixed nozzles may be formed by a simple channel formed directly in the body of the tool and having an appropriate slant of the injection orifice.

Generally, the sum of the sections of the jets orientated preferably towards the central part of the tool will be preferably greater than or equal to a third of the total passage section ST of the nozzles placed on the tool and preferably less than or equal to two thirds of the section ST.

Figure 7:
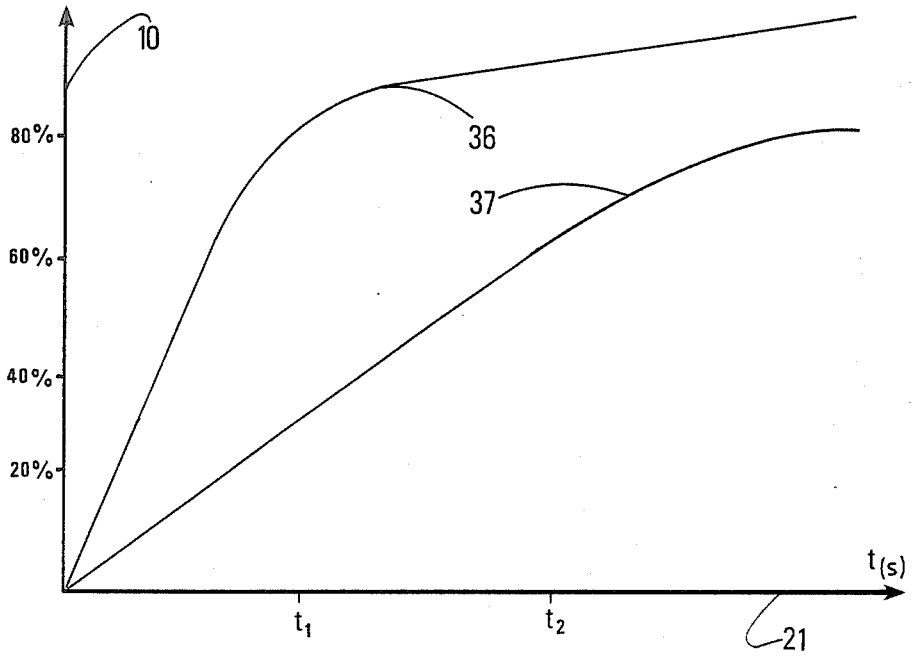
FIG. 7 shows a comparative diagram of the efficiency of the tool of the prior art and of a tool according to the present invention.

FIG. 7. is a diagram showing the gain provided by the invention in the ability of the drilling tool to remove the cuttings which it creates at the bottom of the drilling well.

The axis of the ordinate 10 of this diagram shows the ability of a tool to remove the cuttings.

The axis of the abscissa 21 shows the time during which drilling fluid is caused to pass through the tool.

In this Figure, reference 36 corresponds to the performance curve of a tool of the present invention and reference 37 corresponds to the performance curve of a tool of the prior art.

To obtain these curves, the tool is placed in a cell simulating the bottom of the drilling well. Between the tool and the cell is introduced a given volume V of sand simulating the spoil.

During the experiment, a fluid was caused to flow at a given rate through the tool and the volume of cuttings removed with respect to the volume of spoil initially placed in the cell was recorded as a function of time. The ability of the tool to remove the spoil corresponds to the ratio of the volume of cuttings removed to the initial volume of spoil V.

It will be noted in these curves that for a time $t_1$ the tool of the invention removed a volume of cuttings two to three times greater than that removed by the tool of the prior art.

In the case of the tool of the invention, with the cuttings rapidly removed from the cutting face, the tool is therefore permanently in contact with the rock to be destroyed and not in contact with the spoil which it has just created. This results in increasing the feeding speed of the drilling tool while avoiding recrushing of the spoil by this tool, such recrushing limits the efficiency of the tool and causes initial wear thereof.

The performance curve 37 of the tool of the prior art reaches substantially a horizontal asymptote corresponding to a cuttings removal ability of the order of 80%, which means that the remaining cuttings, i.e. close to 20% of the initial spoil, is very difficult to remove.

On the contrary, the tool of the present invention leaves practically no cuttings in the cell, because more especially of good cleaning of the central part of the tool.

What is claimed is:

1. A method for improving the removal of cuttings from a drilling tool rotating, during operation, about an axis of the tool, said tool comprising a body having a first end adapted for connection to a rotary drive means and a second end delimiting a cutting face, a zone of said second end surrounding said axis forming the central part of the tool, and said tool having at least one nozzle, the method comprising positioning said nozzle to produce a flow of fluid orientated towards the central part of the tool such that the vector of the speed of said flow obtained by an orthogonal projection on a plane perpendicular to the axis of the tool in the central part of the tool being different from zero at any point on said central part, said vector forming an effective speed vector.

2. The method as claimed in claim 1 wherein said tool has several nozzles and said nozzles are positioned and dimensioned so as to produce in the central part of the tool a resultant flow whose effective speed vector is different from zero at any point on said central part of the tool.

3. The method as claimed in claim 1, wherein said tool comprises additional nozzles adapted for producing flows having a tangential speed component, different from zero with respect to a circle centered on a point belonging to the axis of the tool.

4. The method as claimed in claim 1, wherein a plurality of said nozzles are positioned so that there exists at least one axis, called circulation axis, belonging to said plane perpendicular to the axis of the tool, and wherein the different circulation vectors obtained by the orthogonal projection on said circulation axis of the different effective speed vectors at any point of the central part are orientated in the same direction.

5. A drilling tool for implementing the method as claimed in claim 1, comprising at least a first nozzle positioned at a first position on the tool, said nozzle comprising an injection channel having an axis orientated substantially towards the central part of the tool.

6. The drilling tool as claimed in claim 5, further comprising at least a second nozzle positioned on the side of the tool opposite that containing the first nozzle, said opposite side being defined by the portion of the tool situated in the half space defined by a first plane passing through the axis of the tool, perpendicular to a second plane containing a point of the injection orifice of said first nozzle as well as the axis of the tool, said second nozzle comprising an injection channel adapted for producing a flow substantially orientated in the direction away from the central part of the tool.

7. The tool as claimed in claim 6, wherein said second nozzle is positioned on the tool substantially in a half plane belonging to the second plane, said half plane being defined by the axis of the tool.

8. The tool as claimed in claim 5, further comprising several fluid nozzles having fluid injection channels each with an axis orientated towards the central zone of the tool and wherein said nozzles are positioned on the tool on the same side with respect to a plane passing through the axis of the tool.

9. The tool as claimed in claim 5, further comprising a third nozzle having a third channel, said third nozzle being positioned substantially in the vicinity of said first nozzle, the axis of said third channel being oriented substantially in the direction opposite to that of the injection channel of the first nozzle to produce a flow of fluid away from the central part of the tool.

* * * * *